US009464794B2

(12) United States Patent
Masterman et al.

(10) Patent No.: US 9,464,794 B2
(45) Date of Patent: Oct. 11, 2016

(54) REMOVABLE LIGHTING ASSEMBLIES

(71) Applicant: Next Step Products LLC, Orlando, FL (US)

(72) Inventors: Mark Masterman, Orlando, FL (US); Roy Archer, Orlando, FL (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 34 days.

(21) Appl. No.: 14/073,373

(22) Filed: Nov. 6, 2013

(65) Prior Publication Data

US 2015/0124435 A1 May 7, 2015

(51) Int. Cl.

| | |
|---|---|
| ***F21V 19/04*** | (2006.01) |
| ***F21S 8/00*** | (2006.01) |
| ***F21V 5/04*** | (2006.01) |
| ***F21V 17/00*** | (2006.01) |
| ***F21V 23/00*** | (2015.01) |
| *F21V 31/00* | (2006.01) |
| *F21W 131/401* | (2006.01) |
| *F21Y 101/02* | (2006.01) |
| *F21Y 113/00* | (2016.01) |

(52) U.S. Cl.

CPC ..... *F21V 19/04* (2013.01); *F21S 8/03* (2013.01); *F21V 5/04* (2013.01); *F21V 17/002* (2013.01); *F21V 23/006* (2013.01); *F21V 31/005* (2013.01); *F21W 2131/401* (2013.01); *F21Y 2101/02* (2013.01); *F21Y 2113/005* (2013.01); *Y10T 29/4973* (2015.01)

(58) Field of Classification Search

CPC ..... F21V 19/04; F21S 8/03

See application file for complete search history.

(56) References Cited

U.S. PATENT DOCUMENTS

| | | | |
|---|---|---|---|
| 3,302,014 | A | 1/1967 | Moore et al. |
| 5,045,978 | A | 9/1991 | Gargle |
| 6,203,173 | B1 | 3/2001 | Duff et al. |
| 7,534,009 | B2 | 5/2009 | Trojanowski et al. |
| 7,604,364 | B2 | 10/2009 | Walker et al. |
| 7,722,216 | B2 | 5/2010 | Amor et al. |
| 7,740,367 | B2 | 6/2010 | Koren |
| 7,832,910 | B2 | 11/2010 | Kauffman |
| 8,123,372 | B1 | 2/2012 | Ball et al. |
| 8,172,434 | B1 | 5/2012 | Olsson |
| 8,567,986 | B2 | 10/2013 | Szprengiel et al. |
| 2009/0025271 | A1 | 1/2009 | Duckworth |

(Continued)

OTHER PUBLICATIONS

Patent Cooperation Treaty, "International Search Report" issued in International Application No. PCT/US2014/059889, by U.S. Searching Authority, document of 9 pages, Jan. 21, 2015.

*Primary Examiner* — Elmito Breval

(74) *Attorney, Agent, or Firm* — Akerman LLP

(57) ABSTRACT

Pool lighting assemblies, lens and methods of installing, maintaining and servicing are disclosed. A pool lighting assembly can include a light fixture body forming an elongated housing with a generally open interior, where the light fixture body constructed for insertion into a structure, such a pool wall. Additionally, a light cartridge can be provided. The light cartridge can have an illumination portion with a light emitting diode, a circuitry portion for controlling the light emitting diode, and a heat sink in proximity of the light emitting diode and the circuitry portion. A lens assembly, attachable to the light fixture body, can also be provided. The lens of the lens assembly can be interchangeable with a different lens. Also, the light cartridge can be removable from the light fixture body without removing the light fixture body from the structure.

17 Claims, 5 Drawing Sheets

(56) References Cited

U.S. PATENT DOCUMENTS

2012/0300441 A1 11/2012 Thomas et al.
2013/0170235 A1 7/2013 Armstrong
2013/0215394 A1* 8/2013 Reddy ..... G09G 5/10 353/31

* cited by examiner

REMOVABLE LIGHTING ASSEMBLIES

FIELD OF THE DISCLOSURE

The present disclosure generally relates to lighting assemblies, and more particularly relates to removable lighting assemblies.

BACKGROUND

Initially, pool lighting was used strictly for safety purposes. For example, nighttime swimming, was done with much greater safety at night with lighted pools for obvious reasons. However, pool lighting can be used to make an attractive back yard look outstanding. New pool lighting fixtures allow for greater creativity and expanded use both for swimming and non-swimming events.

Water within a swimming pool can be lighted by an incandescent light that is housed within a fixture that is situated within a pool wall cavity. When a new bulb is needed, the whole fixture is removed from the cavity when the power cable supplying electricity to the light is long enough for the fixture to be safely positioned out of and away from the pool water. Even if a light fixture is located above the pool water, long power cables are still used to provide excess cable length. This, however, is still cumbersome.

SUMMARY

Pool lighting assemblies, lenses and methods of installing, maintaining and servicing are disclosed. The components are detailed below, and can include a removable cartridge and removable lenses. The lenses can provide different patterns based on the various arrangement of translucent and opaque portions thereof. These provide advantages over the prior art as the components thereof can be removed or serviced without the need for removing the housing that is fixed in a pool wall, for example.

A pool lighting assembly can include a light fixture body forming an elongated cylindrical housing with a generally open interior, where the light fixture body is constructed for insertion into a structure, such a pool wall. Additionally, a light cartridge can be provided. The light cartridge can have an illumination portion with a light emitting diode, a circuitry portion for controlling the light emitting diode, and a heat sink in proximity of the light emitting diode and the circuitry portion. A lens assembly, attachable to the light fixture body, can also be provided. The lens of the lens assembly can be interchangeable with a different lens. Also, the light cartridge can be removable from the light fixture body without removing the light fixture body from the structure. Also, the heat sink can include a channel for wires connecting the light emitting diode engine to a printed circuit board of the light cartridge.

In one embodiment, the light fixture body can further include a flange attached at a light end of the light fixture body. The light fixture body can include threads onto which the flange with internal matching threads is secured to create a water tight seal. Also, the lens assembly can attach to the flange of the light fixture body.

In one arrangement, the light fixture body can be translucent such that when the light cartridge is located in the light fixture body, the light cartridge can be viewed. Also, the light fixture body can further include a power source contact. Further, the light cartridge can also provide a printed circuit board having a male electrical contact for insertion into the power source contact.

In one embodiment, the lens can have a first portion and a second portion, and the first portion and the second portion may have different translucent properties. In one arrangement, the first portion of the lens can be opaque and the second portion of the lens can be translucent.

In another embodiment, a removable pool lighting assembly component is provided. A light cartridge can have an illumination portion with a light emitting diode engine, a circuitry portion for controlling the light emitting diode engine, and a heat sink in proximity of the light emitting diode engine and the circuitry portion. The light cartridge can be configured for removable insertion into a light fixture body forming an elongated cylindrical housing with a generally open interior, the light fixture body constructed for insertion into a structure. For example, the structure can be a pool wall. The component can also include a tool aperture disposed adjacent to the light emitting diode engine. The tool aperture can be configured to receive a tool for removing the light cartridge. Also, the light cartridge is removable from the light fixture body without removing the light fixture body from the structure.

In another embodiment, the light cartridge can also include a printed circuit board having a male electrical contact for insertion into a power source contact of the light fixture body. Also, the male electrical contact can be rectangular and can be inserted into a corresponding shaped cavity of the power source contact. Further, the heat sink can include a channel for wires connecting the light emitting diode engine to the printed circuit board.

A method of performing maintenance on a pool lighting assembly is also disclosed. The method can include removing a light cartridge having an illumination portion with a light emitting diode engine, a circuitry portion for controlling the light emitting diode engine, and a heat sink in proximity of the light emitting diode engine and the circuitry portion. The light cartridge can be removed from a light fixture body forming an elongated cylindrical housing with a generally open interior, the light fixture body constructed for insertion into a structure. The light cartridge can be removed from the light fixture body without removing the light fixture body from the structure. The method can also include inserting a replacement light cartridge into the light fixture body so that a male electrical contact of a printed circuit board of the circuitry portion of the light fixture body inserts into a corresponding shaped cavity of a power source contact of the light fixture body. Further, a light fixture assembly can be sealed to the light fixture body.

Further, removing the light cartridge can comprise inserting a tool into a tool aperture disposed adjacent to the light emitting diode engine to remove the light cartridge. Removing the light cartridge can also include using the tool to dislodge the male electrical contact of the printed circuit board of the circuitry portion of the light fixture body from the power source contact of the light fixture body. The tool can be a hex key. Further, the method can include replacing an existing lens with a lens having a first portion and a second portion, wherein the first portion and the second portion have different translucent properties. The first portion of the lens can be opaque and the second portion of the lens can be translucent.

These and other features of the are described in the following detailed description, drawings, and appended claims.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

DETAILED DESCRIPTION OF THE DRAWINGS

Figure 1A:
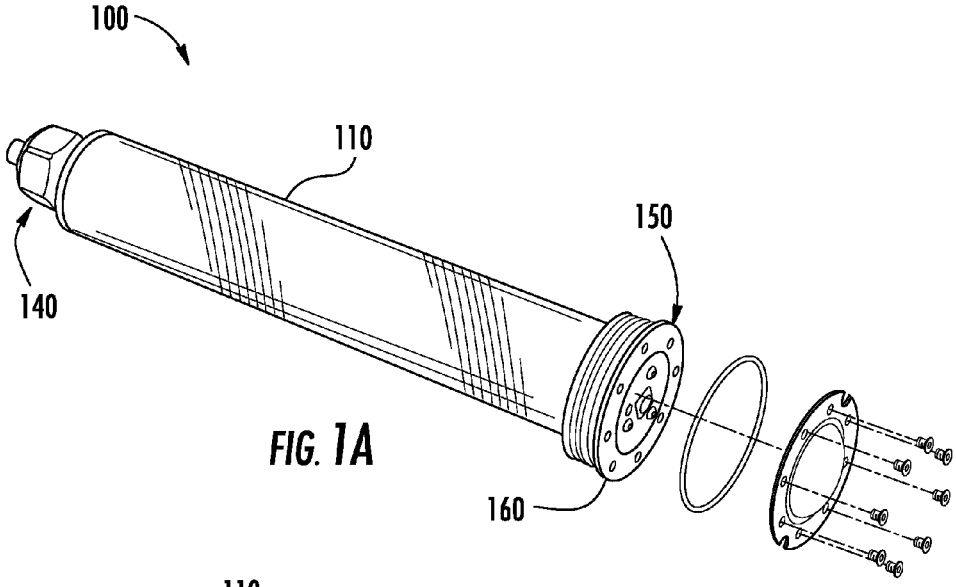
FIG. 1A is a diagram illustrating portions of a light assembly in accordance with one embodiment of the present disclosure.
Figure 1B:
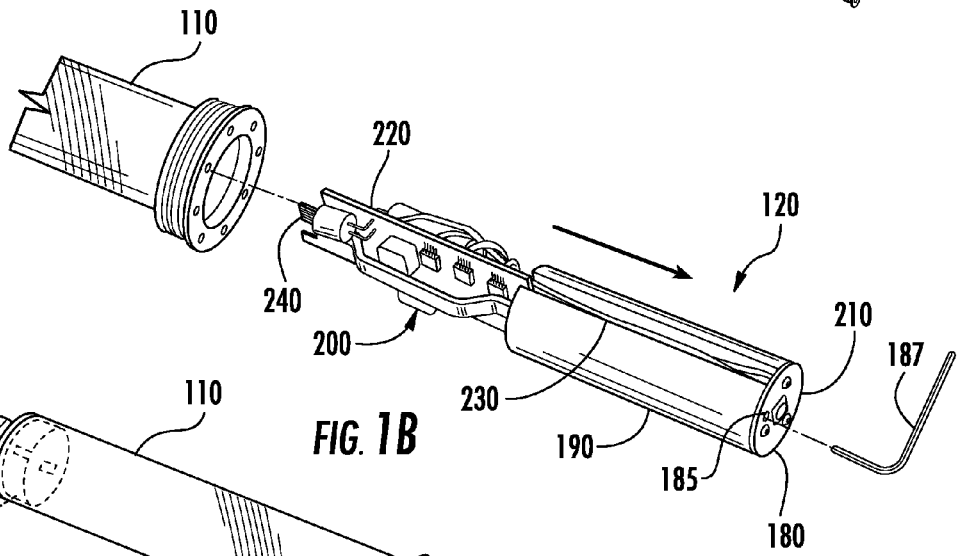
FIG. 1B is a diagram illustrating portions of the light assembly of FIG. 1A in accordance with one embodiment of the present disclosure.
Figure 1C:
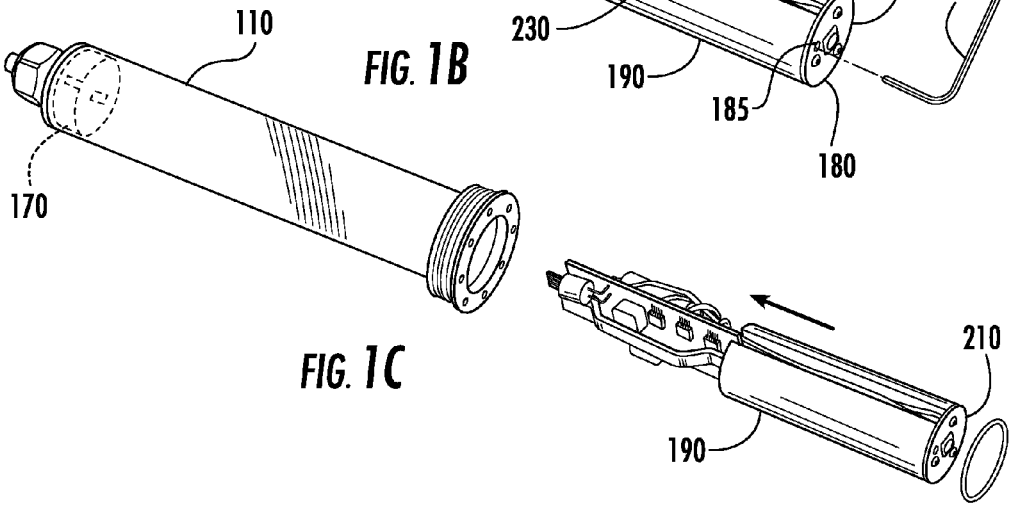
FIG. 1C is a diagram illustrating additional portions of the light assembly of FIG. 1A in accordance with one embodiment of the present disclosure.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others.

Referring to FIGS. 1A-1D and FIGS. 2A and 2B, a lighting assembly 100 according to one embodiment is disclosed. The lighting assembly can include a light fixture body 110, a light cartridge 120 and lens assembly 130, all of which can include additional components.

The light fixture body 110 can be an elongated, hollow cylindrical housing with a generally open interior which can house the light cartridge 120 when assembled. The light fixture body 110 can have a power source end 140 and a light end 150. The light fixture body 110, when assembled, can provide a waterproof housing for the light cartridge 120. Further, the light fixture body 110 can be comprised of any appropriate material, such as polyvinyl chloride, commonly abbreviated PVC, or other hard plastic, and can be translucent so that the light cartridge 120 can be viewed when the light cartridge 120 is inserted into the light fixture body 110 and the light assembly is assembled. The light fixture body 110 can be installed into a structure, such as a pool or hot tub wall, either above or below the waterline.

The light end 150 of light fixture body 110 can include threads onto which a flange 160 with internal matching threads can be secured to create a water tight seal. The flange 160 can extend beyond the outer surface of the light fixture body 110. The flange 160 can also include a plurality of openings for receiving screws for securing a lens assembly 130, as discussed below.

At the power source end, a power source contact 170 can be provided. The power source contact 170 can provide the contact for supplying power to the light cartridge 120. The power source contact 170 can be coupled to an appropriate power supply, such as a 12-14V power supply. Other power supplies can be used depending upon the type of light used and/or other components.

Further, the power source contact 170 can be arranged to accept the light cartridge 120 when the light cartridge 120 is in a certain orientation. This predetermined positioning and arrangement of the light cartridge 120 can ensure that the light cartridge 120 is in the desired orientation to provide the desired lighting effects.

The light cartridge 120 can be removably inserted into the light fixture body 110. The light cartridge 120 can include an illumination portion 180, a heat sink 190 and a circuitry portion 200. In one arrangement, the illumination portion 180 and the circuitry portion 200 can be on opposite ends of the light fixture body 110 with the heat sink 190 disposed between the illumination portion 180 and the circuitry portion 200. The illumination portion 180 can include a light emitting diode (LED) engine 210 that can be coupled to the heat sink with thermal glue or gap filler putty and/or one or more screws. As an alternative, one or more LEDs or other illumination elements can be used.

In one embodiment, the LED engine 210 can include high brightness LEDs with a multilayer low temperature co-fired ceramic on metal (LTCC-M). The LTCC-M can allow multiple LEDs to be densely clustered to achieve high luminous intensity in a small array. Any number of LEDs can be used in LED engine 210, and any suitable LED array or light engine can be employed for the LED engine 150. For example, the BL-4000 RGB light engine, which is available from Lamina Ceramics of Westhampton, N.J., has a single cavity with six LEDs, evenly divided among red, green, and blue LEDs for optimal color uniformity. Other LED engines can also be used, such as the BL-3000 RGB light engine also available from Lamina Ceramics, which has 39 cavities that are each populated with multiple LEDs. Each cavity can contain multiple red, green and blue LED dies for optimal color uniformity.

In another embodiment, an individual LED array can be used and can include a metal composite base, a plurality of LEDs, ceramic layers with at least one having electrical traces thereon, and lenses. The LEDs can be mounted directly to the metal composite base, which can be a nickel-plated, copper-molybdenum-copper composite, or any suitable metal composite. The base can be formed of a single metal such as copper or aluminum. Alternatively, a metal composite, such as the nickel-plated, copper-molybdenum-copper composite, can be used because they been found to have a thermal coefficient of expansion that is similar to the typical LED chip material. This similarity can provide compatibility of the LED and substrate through a lifetime of heating and cooling as the LEDs are powered on and off, and can reduce mechanical stress caused by the expansion and retraction created during heating and cooling cycles of the light source 10.

A removal tool aperture 185 can be located adjacent to the LED engine 210 at the illumination portion 180 of the light cartridge 120. The removal tool aperture 185 can be offset from the longitudinal axis of the light cartridge 120. During removal, an extraction tool 187, such a hex key, can be inserted into the removal tool aperture 185 to remove the light cartridge 185 from the light fixture body 110.

The heat sink 190 can dissipate heat away from the components of lighting assembly 100. In one embodiment, the heat sink 190 can be an elongated cylindrical body located between the LED engine 210 and the circuitry portion 200. The heat sink 190 can extend along a substantial portion of the light fixture body 110 so that heat is transferred throughout the heat sink and removed from the lighting assembly 100. The heat sink 190 can be entirely contained within the light fixture body 110. The heat sink 190 provides for thermal management of the lighting assembly 100 without the need for forced or passive ventilation of the inner volume of the light fixture body 100, which may expose the components of the lighting assembly to the elements of the atmosphere. The use of the heat sink 190 can eliminate the need for additional and costly components typically used in thermal management of electronic components, such as fans.

Figure 1D:
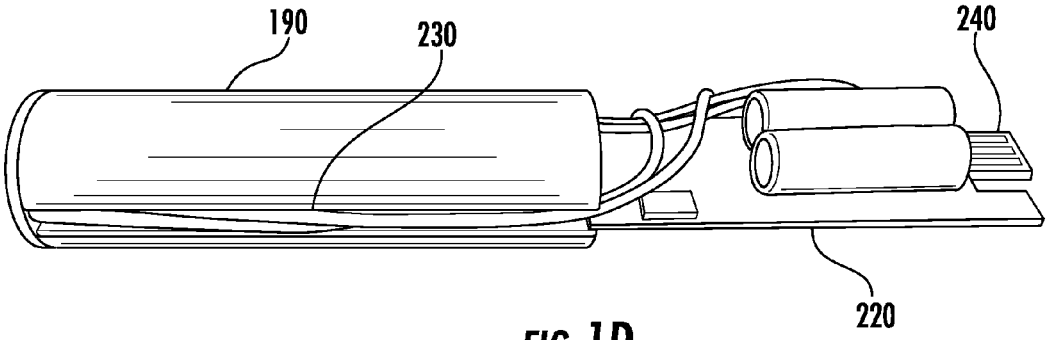
FIG. 1D is a diagram illustrating the opposing side of portions of the light assembly of FIG. 1A in accordance with one embodiment of the present disclosure.
Figure 2A:
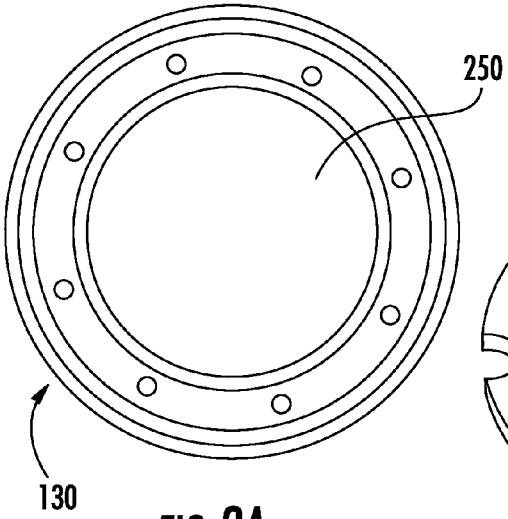
FIG. 2A is a diagram illustrating portions of a lens assembly in accordance with one embodiment of the present disclosure.
Figure 2B:
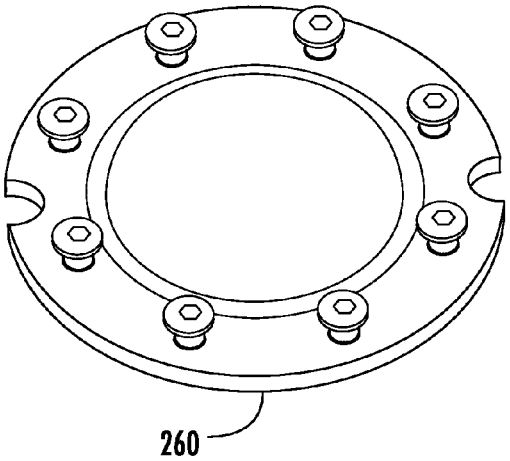
FIG. 2B is a diagram illustrating portions of the lens assembly of FIG. 2A in accordance with one embodiment of the present disclosure.

Additionally, the heat sink 190 may include one or more channels or a grooves 230 to provide a location for connecting electrical wires from the LED engine 210 to a printed circuit board (PCB) 220 located at the circuitry portion 200. In one arrangement as shown in FIG. 1D that illustrates an opposing view of a portion of the embodiment of FIG. 1B, the heat sink 190 can have dual opposing grooves 230 that extend along the length of the heat sink 190. Other arrangements of channels or grooves can be used.

The circuitry portion 200 can include the PCB 220 that is coupled to the heat sink 190 to dissipate heat. The PCB 220 can be operably connected to the LED engine 210, a power supply and/or a controller for providing one or both of power and control for the LED engine 210. In one embodiment, the PCB 220 regulates power for use by the LED engine 210 and provides light output control, such as varying color and/or timing, over LED engine 210. The PCB 220, or its components, can have a pre-determined control logic resulting in desired light output being generated by the LED engine 210. As an alternative to pre-determination, the PCB 220, or its components, can be programmable to implement control resulting in desired light output being generated by the LED engine 210. In another embodiment, the PCB 220 can operably be connected to an external controller, such as DMX protocol controller, and can receive control signals from the external controller for controlling the LED engine 210. The PCB 220 can include various components to power and/or control the LED engine 210, including voltage regulators, power supplies, logic switches, microcontrollers, temperature sensors, thermostats, and analog-to-digital converters.

The PCB 220 can include a male electrical contact 240 for insertion into the power source contact 170. The male electrical contact 240 can be generally rectangular in shape, which will force the light cartridge 120 and LED engine 210 into a certain orientation once inserted. The power source contact can have a cavity of a corresponding shape to the male electrical contact 240. Also, the size and shape of the male electrical contact 240 ensures that even if the light cartridge 120 is inserted into light fixture body 110 with its LED engine 210 first, an electrical contact will not be formed.

The lens assembly 130 can include a lens 250 and lens fixture 260. The lens fixture 260 can include a plurality of openings for receiving screws or other structures to attach the lens assembly 130 to the light fixture body 110. The openings on the lens fixture 260 can be arranged to match the openings on the flange 160 of the light fixture body 110 for attaching the lens assembly 130 to the light fixture body 110. An O-ring 270 can be placed between the flange 160 of the light fixture body 110 and the lens fixture 260 to help create a water tight seal once fully assembled. A silicon bead can also be placed on the lens 250 to ensure a proper seal.

The lens 250 can be a fully translucent lens or can be structured to create certain lighting effects. The lens can be removable to attach different lenses to provide different effects.

Figure 3:
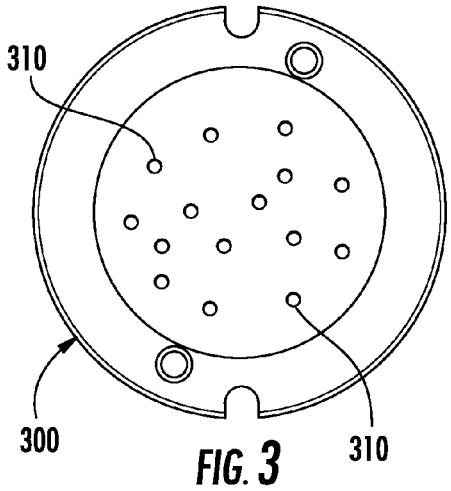
FIG. 3 is a diagram illustrating one embodiment of a lens cover in accordance with one embodiment of the present disclosure.

FIG. 3 illustrates one embodiment of a lens cover 300. The lens cover 300 can include a plurality of light effect spots 310. The light effect spots 310 can be more or less translucent than the remainder of lens cover 300. As an example, the light effect spots 310 can be opaque while the remainder of the lens cover 300 can be translucent. Alternatively, the light effect spots 310 can be translucent while the rest of lens cover 300 is opaque. The light effect spots 310 can be arranged such that when the lens cover 300 is illuminated, the light effect spots 310 produce a light pattern that resembles the stars. In certain embodiments, the arrangement of light effect spots 310 may be varied as desired. The lens cover 300 can be placed over a lens and secured by a fastening member, such as a screw.

Figure 4A:
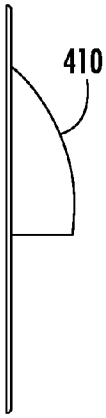
FIG. 4A is a diagram illustrating a side view of one embodiment of a lens cover in accordance with one embodiment of the present disclosure.
Figure 4B:
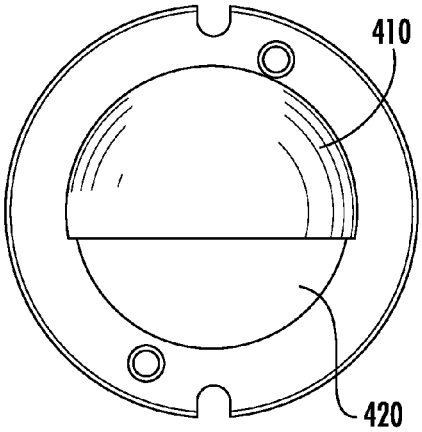
FIG. 4B is a diagram illustrating a front view of one embodiment of the lens cover of FIG. 4A in accordance with one embodiment of the present disclosure.
Figure 4C:
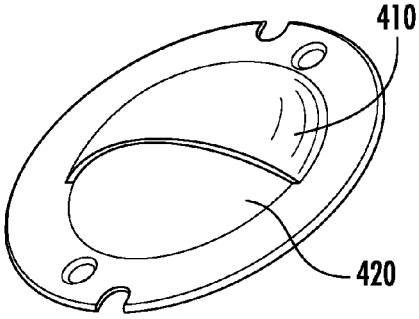
FIG. 4C is a diagram illustrating a perspective view of one embodiment of the lens cover of FIG. 4A in accordance with one embodiment of the present disclosure.

FIGS. 4A-4C illustrates another embodiment of a lens cover 400. The lens cover 400 can include a first portion 410 and second portion 420. The first portion 410 can cover approximately half of the second portion 420. The first portion 410 can be an opaque material and the second portion can be free of any material. As shown in FIGS. 4A and 4C, the opaque portion can cover roughly half of the lens with a moon-shaped structure. Such an arrangement will allow for emitted light to be emitted in a certain direction and pattern. Alternatively, the second portion 420 can be a translucent material or open space. In alternative arrangements, the shape can be a half-moon, quarter-moon, ¾ moon.

Figure 5A:
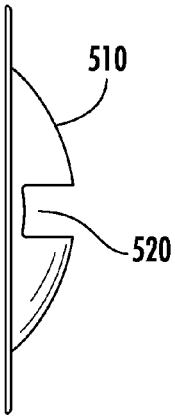
FIG. 5A is a diagram illustrating a side view of one embodiment of a lens cover in accordance with one embodiment of the present disclosure.
Figure 5B:
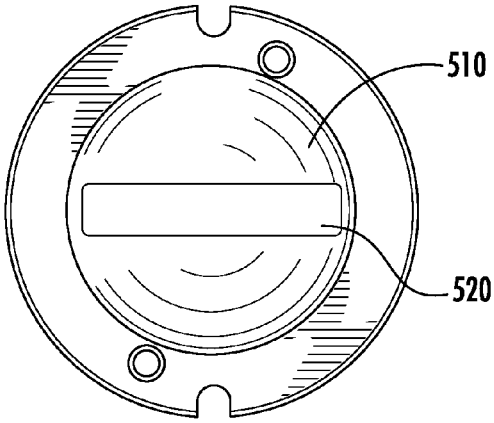
FIG. 5B is a diagram illustrating a front view of one embodiment of the lens cover of FIG. 5A in accordance with one embodiment of the present disclosure.

FIGS. 5A and 5B illustrate yet another embodiment of a lens cover 500. The lens cover 500 can include a first portion 510 and second portion 520. The first portion 510 can be convex and the second portion 510 can form a rectangular bar in the middle of the first portion 510. The first portion 510 and second portion 520 can have opposite translucent properties. Different translucent properties can include one portion being less translucent than the other. For instance, the first portion 510 can be opaque while the second portion 520 can be translucent. Such an arrangement will allow for emitted light to be emitted in a certain direction and pattern. As an alternative, the first portion 510 can be translucent while the second portion 520 can be opaque to provide a different lighting effect. The rectangular bar portion 520 can have a length that is less than or equal to the radius of the first portion 510. The positioning of the rectangular bar portion 520 can also be rotated to a certain angle so that it is not horizontal.

Figure 6:
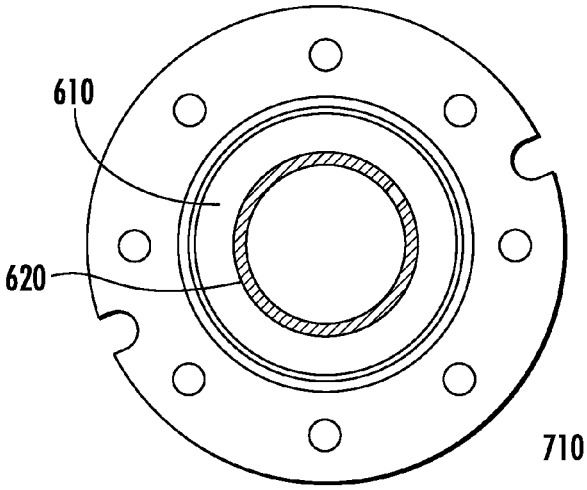
FIG. 6 is a diagram illustrating one embodiment of a lens in accordance with one embodiment of the present disclosure.

FIG. 6 is an embodiment of a lens 600. The lens 600 can include a first portion 610 and second portion 620. The first portion can form a convex lens and the second portion 610 can form a ring within the first portion 610. The first portion 610 and second portion 620 can have opposite translucent properties. Different translucent properties can include one portion being less translucent than the other. For instance, the first portion 610 can be opaque while the second portion 620 can be translucent. Such an arrangement will allow for emitted light to be emitted in a certain direction and pattern, such as to form a halo. As an alternative, the first portion 610 can be translucent while the second portion 620 can be opaque to provide a different lighting effect. Also, the radius of the second portion 620 can increase to an amount just under the radius of the first portion 610. Likewise, the radius of the second portion 620 can decrease to any desired size.

Figure 7:
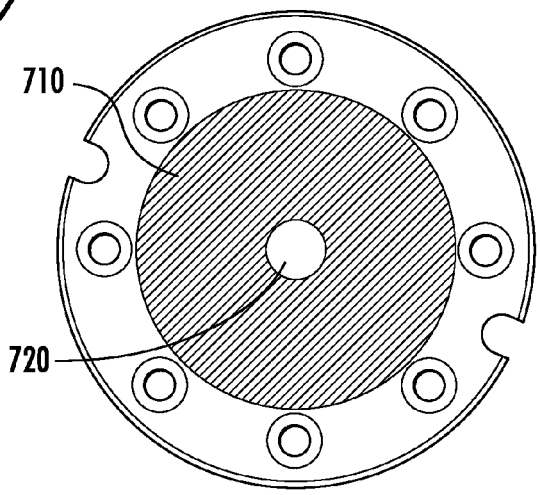
FIG. 7 is a diagram illustrating one embodiment of a lens in accordance with one embodiment of the present disclosure.

FIG. 7 illustrates yet another embodiment of a lens 700. The lens 700 can include a first portion 710 and second portion 720. The first portion can form a convex lens and the second portion 710 can form a circle within the first portion 710. The first portion 710 and second portion 720 can have opposite translucent properties. Different translucent properties can include one portion being less translucent than the other. For instance, the first portion 710 can be opaque while the second portion 720 can be translucent. Such an arrangement will allow for emitted light to be emitted in a certain direction and pattern, such as to form a spotlight. As an alternative, the first portion 710 can be translucent while the second portion 720 can be opaque to provide a different lighting effect. Also, the second portion 720 can be located in any other area of the first portion 710 so that a spotlight can be projected at an angle from the lens 700.

Figure 8A:
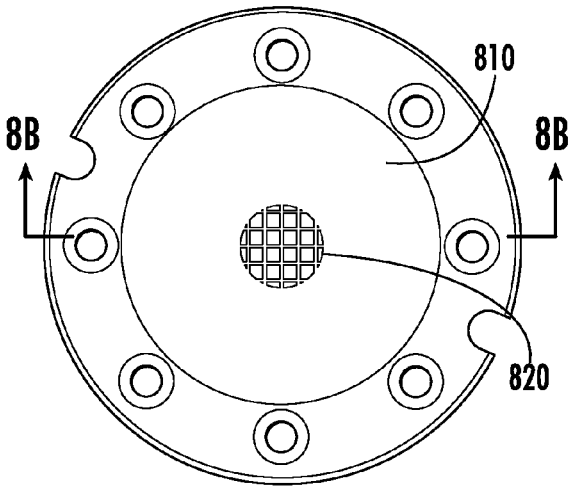
FIG. 8A is a diagram illustrating a side view of one embodiment of a lens in accordance with one embodiment of the present disclosure.
Figure 8B:
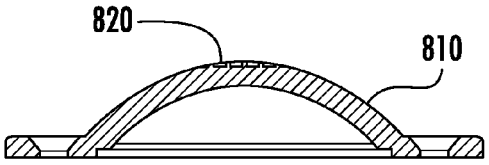
FIG. 8B is a diagram illustrating a front view of one embodiment of the lens of FIG. 8A in accordance with one embodiment of the present disclosure.

FIGS. 8A and 8B illustrates still another embodiment of a lens 800. The lens 800 can include a first portion 810 and second portion 820. The first portion can form a convex lens and the second portion 810 can form a circle within the first portion 810. The first portion 810 and second portion 820 can have opposite translucent properties. Different translucent properties can include one portion being less translucent than the other. For instance, the first portion 810 can be opaque while the second portion 820 can be translucent. The second portion can also have a pattern formed by crossing lines or honeycomb configuration of opaque elements. Such an arrangement will allow for emitted light to be emitted in a certain direction and pattern, such as to form a starfield. As an alternative, the first portion 810 can be translucent while the second portion 820 can be opaque to provide a different lighting effect. The second portion 820 can be located at any location along the first portion 810.

Figure 9:
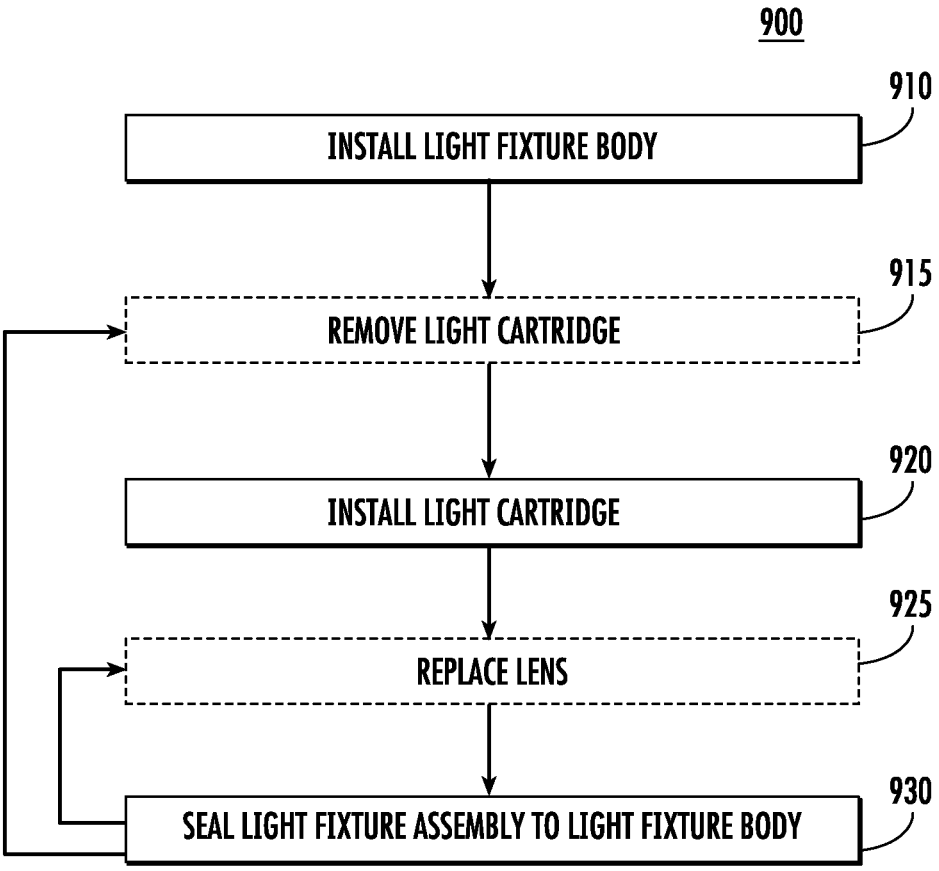
FIG. 9 is a flow diagram illustrating an exemplary method of installing removable light assemblies in accordance with embodiments of the present disclosure.

For installation, maintenance and servicing of the light assemblies and with reference to FIG. 9, method 900 can be followed. At 910, the method 900 can include installing the light fixture body 110 discussed above. Installing the light fixture body 110 can include placing the light fixture body 110 in a cavity in a pool wall. The power source end 140 can be plugged into an appropriate power source.

With the light fixture body 110 installed, the light cartridge 120 can be installed or replaced at 920. The light cartridge 120 can be inserted into the light fixture body 110 with the male electrical contact 240 of the light PCB 220 being inserted first. The male electrical contact 240 can be inserted into the power source end 140 to make an electrical connection. The insertion slot of the power source end 140 and the male electrical contact 240 are shaped so that the light cartridge 120 may need to be rotated with respect to the light fixture body 110 until the two components align and the male electrical contact 240 inserts into the power source end 140.

Once installed, the light cartridge 120 and/or the light engine on the light cartridge 120 can be removed and replaced without removing the light fixture body from the pool wall at 915. Advantageously, the removal and installation of a new or replacement light cartridge 120 or light engine can be completed without removing the light fixture body 110 and without the need for excess power cord. To remove an already inserted light cartridge 120, a hex key 187 can be inserted into the illumination portion 180 of the light cartridge 120 into the removal tool aperture 185. Once inserted, the hex key 187 can be used to remove the light cartridge 120 from the light fixture body 110. The hex key 187 can be used to rotate or otherwise move the light cartridge 120 if it is inserted into the power supply end 170. Once dislodged from the power supply end 170, the light cartridge 120 can be removed from the light fixture body 110.

With the light cartridge 120 installed, the lens assembly 130 can be secured to the light fixture body 110 at 930. The lens assembly 130 can be secured to the light fixture body 110 by using one or more screws to securely attach the lens assembly 130. Additionally, an O-ring or gasket can be placed between the light fixture body 110 and the lens assembly 130 to ensure a tight fit. Still further, a silicon bead can be used on the screws before they are inserted and placed on or around the area of the O-ring or gasket to create a water tight seal.

Once a lens 250 is installed, a lens 250 can be replaced with a different lens at 925. First, the existing lens 250 can be removed by removing the lens 250 assembly 130. The lens assembly 130 can be removed by unscrewing the screws that were used to attach the lens assembly 130 to the light fixture body 110. A new or different lens 250 can be attached as set forth in 930 above. Advantageously, replacing only the lens 250 without removing the light fixture body 110 can allow the lens 250 to be changed with minimal servicing.

Alternatively, a lens cover can installed at 925. The lens cover can be placed over an existing lens to change the light effect of the device. The lens cover can secured to the lens 250 assembly 130 with any suitable means, such as screws.

The illustrations of arrangements described herein are intended to provide a general understanding of the structure of various embodiments, and they are not intended to serve as a complete description of all the elements and features of apparatus and methods that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

We claim:

1. A pool lighting assembly, comprising:

a light fixture body forming an elongated housing with a generally open interior, the light fixture body constructed for insertion into a structure;

a light cartridge having an illumination portion with a light emitting diode, a circuitry portion for controlling the light emitting diode, and a heat sink in proximity of the light emitting diode and the circuitry portion;

a lens assembly attachable to the light fixture body, the lens of the lens assembly being interchangeable with a different lens;

a tool aperture disposed adjacent to a light emitting diode engine of the illumination portion, the tool aperture configured to receive a tool for removing the light cartridge;

wherein the light cartridge is removable from the light fixture body without removing the light fixture body from the structure; and wherein the circuitry portion of the light cartridge further comprises a printed circuit board having a male electrical contact for insertion into a corresponding shaped cavity of a power source contact of the light fixture body.

2. The light assembly of claim 1, wherein the lens comprises a first portion and a second portion and the first portion and the second portion have different translucent properties.

3. The light assembly of claim 2, wherein the first portion of the lens is opaque and the second portion of the lens is translucent.

4. The light assembly of claim 3, wherein the first portion of the lens and the second portion of the lens for a design selected from the group consisting of a spotlight, a star field, or halo or a combination thereof.

5. The light assembly of claim 1, wherein the light fixture body further comprises a flange attached at a light end of the light fixture body.

6. The light assembly of claim 5, wherein the light fixture body includes threads and the flange has internal matching threads, whereby the light fixture body can be secured to the flange to create a water tight seal.

7. The light assembly of claim 6, wherein the lens assembly attaches to the flange of the light fixture body.

8. The light assembly of claim 1, wherein the light fixture body is translucent such that when the light cartridge is located in the light fixture body, the light cartridge can be viewed.

9. The light assembly of claim 1, wherein the heat sink includes a channel for wires connecting the light emitting diode engine to the printed circuit board.

10. A removable pool lighting assembly component, comprising:

a light cartridge having an illumination portion with a light emitting diode engine, a circuitry portion for controlling the light emitting diode engine, and a heat sink in proximity of the light emitting diode engine and the circuitry portion, the light cartridge being configured for removable insertion into a light fixture body forming an elongated housing with a generally open interior, the light fixture body constructed for insertion into a structure;

a tool aperture disposed adjacent to the light emitting diode engine, the tool aperture configured to receive a tool for removing the light cartridge; and wherein the light cartridge is removable from the light fixture body without removing the light fixture body from the structure.

11. The removable pool lighting assembly component of claim 10, wherein the light cartridge further comprises a printed circuit board having a male electrical contact for insertion into a power source contact of the light fixture body.

12. The removable pool lighting assembly component of claim 11, wherein male electrical contact is rectangular and inserts in to a corresponding shaped cavity of the power source contact.

13. The removable pool lighting assembly component of claim 10, wherein the heat sink includes a channel for wires connecting the light emitting diode engine to the printed circuit board.

14. A method of performing maintenance on a pool lighting assembly, comprising: removing a light cartridge having an illumination portion with a light emitting diode engine, a circuitry portion for controlling the light emitting diode engine, and a heat sink in proximity of the light emitting diode engine and the circuitry portion, the light cartridge being removed from a light fixture body forming an elongated housing with a generally open interior, the light fixture body constructed for insertion into a structure, wherein the light cartridge is removed from the light fixture body without removing the light fixture body from the structure inserting a replacement light cartridge into the light fixture body so that a male electrical contact of a printed circuit board of the circuitry portion of the light cartridge inserts in to a corresponding shaped cavity of a power source contact of the light fixture body; sealing a light fixture assembly to the light fixture body, and wherein removing the light cartridge further comprises inserting a tool into a tool aperture disposed adjacent to the light emitting diode engine to remove the light cartridge.

15. The method of performing maintenance on a pool lighting assembly of claim 14, wherein removing the light cartridge further comprises using the tool to dislodge the male electrical contact of the printed circuit board of the circuitry portion of the light cartridge from the power source contact of the light fixture body.

16. The method of performing maintenance on a pool lighting assembly of claim 14, further comprising replacing an existing lens with a lens having a first portion and a second portion, wherein the first portion and the second portion have different translucent properties.

17. The method of performing maintenance on a pool lighting assembly of claim 16, wherein the first portion of the lens is opaque and the second portion of the lens is translucent.

* * * * *